United States Patent [19]

Stein

[11] 4,405,057

[45] Sep. 20, 1983

[54] SECURITY BOX HAVING SLIDING CLOSURE

[75] Inventor: Eric D. Stein, Cincinnati, Ohio

[73] Assignee: Nestier Corporation, Cincinnati, Ohio

[21] Appl. No.: 317,757

[22] Filed: Nov. 3, 1981

[51] Int. Cl.[3] ..... B65D 43/20

[52] U.S. Cl. ..... 220/346; 220/210; 206/508; 109/45; 109/49

[58] Field of Search ..... 109/45, 49; 220/210, 220/214, 345, 346; 206/508, 509

[56] References Cited

U.S. PATENT DOCUMENTS 926,537 6/1909 Bagley ..... 220/346

3,979,016 9/1976 Frater ..... 206/508

4,325,646 4/1982 Sasaki ..... 220/346

*Primary Examiner*—George T. Hall

*Attorney, Agent, or Firm*—Thomas E. Beall, Jr.

[57] ABSTRACT

A security storage box for papers of a similar size, such as checks, is provided by a one piece molded container, one piece molded lid, and accessories such as a handle, key lock securing the lid to the container, adjustable interior partition wall to adjust the container for a different volume of papers, and a transparent envelope on one end wall of the container to secure identification cards. The container and lid are provided with various reinforcing ribs and flanges, and an interlocking structure to secure multiple lidded containers in a stacked position with like end walls aligned.

21 Claims, 21 Drawing Figures

SECURITY BOX HAVING SLIDING CLOSURE

BACKGROUND OF THE INVENTION

There is a need to store, transport, and selectively view papers having information on them. This need has been in part satisfied by various small portable boxes that usually have diadvantages relating to their strength, short life, inability to properly hold a small number of papers, and high expense in view of their short life. These boxes are usually made from paper. Metal file cabinets that are well known in offices overcome the difficulties mentioned above, but are too heavy for usual transport, quite expensive, and at least with respect to the lower drawers, difficult to work with when it is desired to view the documents.

Many various general purpose containers are known, but in general they are unsuitable for the above-mentioned usage.

SUMMARY OF THE INVENTION

It is an object of the present invention to provide a box that may adequately transport, store, and provide viewing of papers or documents, such as checks, which are generally of a similar size and shape. Particularly, this is done in a secure fashion wherein a lid and lock may be provided, and cheaply wherein molded synthetic resin is used as the primary material. The boxes are lightweight and small so that they may be easily handled for moving them from one office to another, for placement upon a desk for easy viewing of the documents contained therein, and for moving them into and out of storage. This handling is facilitated by a handle pivotally secured to one end of the box.

The volume of the boxes may be easily changed by means of an adjustable and lockable interior partition.

The contents of the boxes are noted on cards that are inserted within a transparent envelope at one end of the box. Interlocking structure is provided when stacking the boxes so that they may be stacked in only one orientation, whereby the identification cards for all the stacked boxes may be read at one end only.

Security for the boxes is provided by a lid that interlocks and is prevented from being removed by a lock, such as a key lock, or aligned apertures in the lid and container that may pass therethrough a security tie or pad lock, or the like.

BRIEF DESCRIPTION OF THE DRAWING

Further objects, features and advantages of the present invention will become more clear from the following detailed description of a preferred embodiment shown in the accompany drawing, wherein.

DETAILED DESCRIPTION OF A PREFERRED EMBODIMENT

Figure 1:
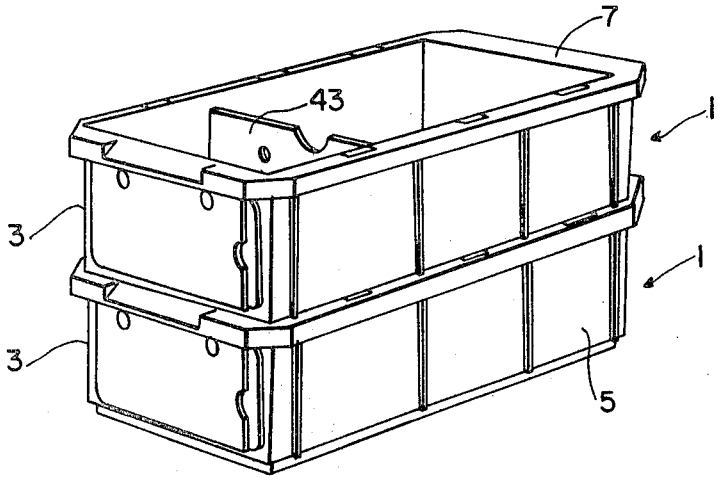
FIG. 1 is a perspective view of one end of two containers, without lids, that are stacked togther.

A preferred embodiment will be described in detail and is shown in the drawing for purposes of illustration of the broader principles of the present invention and further for showing details that are specific features of the present invention. Like numerals are shown throughout the various figures to indicate like structure.

Figure 2:
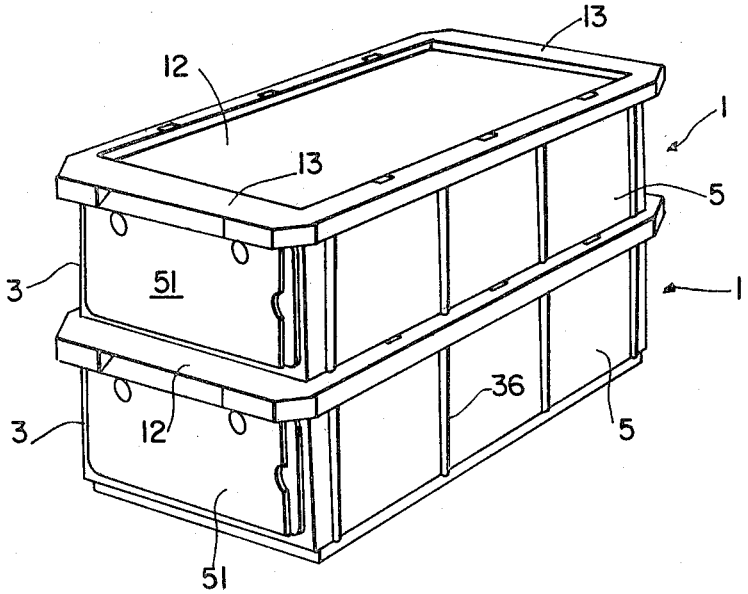
FIG. 2 is a perspective view corresponding to FIG. 1, but with lids being provided for each of the containers.

In FIG. 1, two containers 1 are shown stacked one upon the other so that their end walls 3 may face a user for observing and looking through documents held in the top container, or merely for storing documents where a lid is not required. Each container is of identical structure. In FIG. 2, the same containers are shown in the same position, but each is now provided with a lid 12. The lids are of identical structure.

Each container is provided with opposite end walls 2 and 3, and opposite side walls 4 and 5, which are integrally joined in one piece with each other to form a continuous rectangular vertical wall, and which in turn are integrally joined in one piece with a bottom wall 6. The container is preferably molded in one piece from a synthetic resin, for example polyurethane. The end walls and side walls are preferably vertical, although when molded of one piece, they necessarily have a small mold taper, for example one degree. Their lowermost edges are entirely connected to the entire periphery of the rectangular bottom wall 6. The vertically extending edges of the side and end walls are entirely connected in one piece with their adjacent walls.

The upper edge portions of the side walls 4, 5 and end walls 2, 3 include outwardly extending horizontal flanges 7, connected together around substantially the entire upper periphery of the container to constitute side flanges 8, 9 and end flanges 10, 11.

The lid 12 is preferably molded in one piece from a synthetic resin, for example polyurethane. The lid is of rectangular shape and of a size to close the open top of the container 1, with the peripheral edge portion of the lid being rectangular and having a flange 13 overlying the flange 7 of the container.

Figure 18:
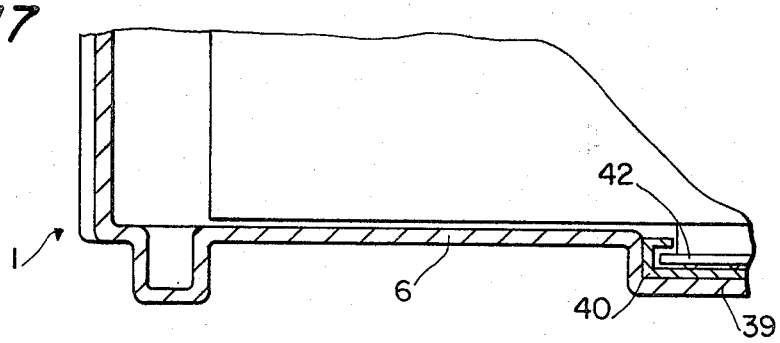
FIG. 18 is a cross-sectional view taken along line 18—18 of FIG. 4.
Figure 18:
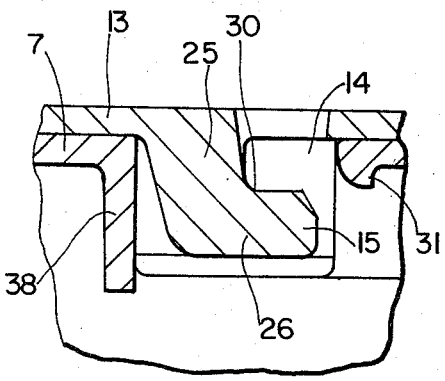

The lid 12 is interlockingly assembled onto its container. For this purpose, the flange 7 of the container is provided with a plurality of through apertures 14, preferably with three being in each of the side flanges 8, 9. The lid is integrally formed with a plurality of depending hooks 15 molded in one piece with the lid and at positions such that they are in general alignment with and extend through the apertures 14 when the lid is assembled on the container. For assembly of the lid, the lid is placed above the container with the hooks 15 aligned with the aperture 14, and thereafter the lid is moved downwardly so that the hooks 15 will extend through the apertures 14 as shown in FIG. 18. Thereafter, the lid is translated horizontally relative to the container toward the container end wall 2, so that the hooks will assume the locked position shown in FIG. 19. In FIG. 18, a closed position is shown wherein the lid actually closes the container although it is not locked, and when the lid is moved vertically upward from the position of FIG. 18 to completely disengage the lid and container, any such positions are referred to as a disengaged position.

Figure 12:
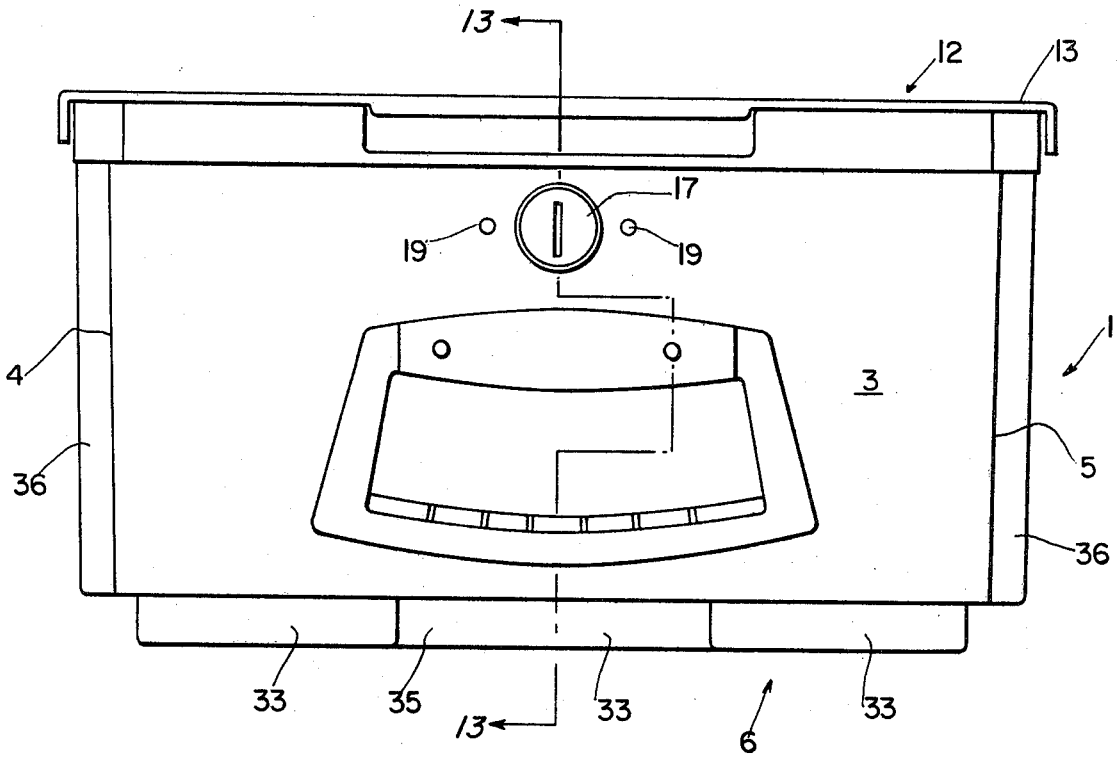
FIG. 12 is a detailed end view of the container corresponding to FIG. 7, and illustrating the auxiliary devices.
Figure 14:
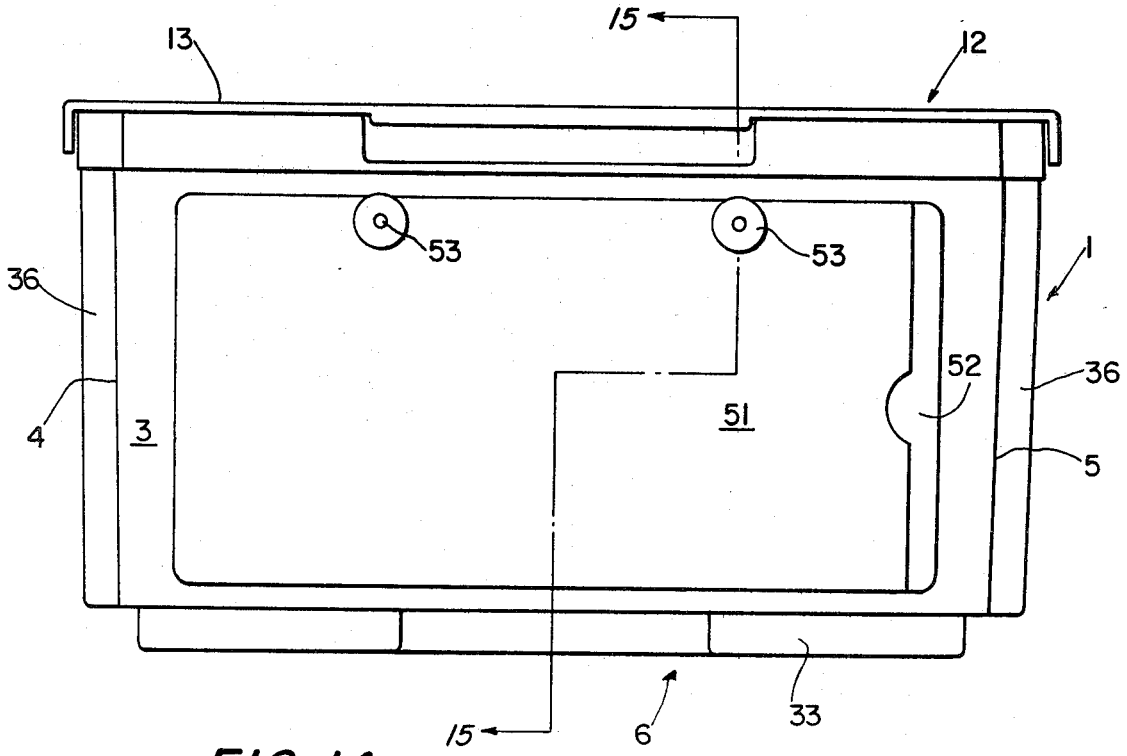
FIG. 14 is a detailed end view similar to FIG. 12, but showing additional assembled auxiliary devices.
Figure 13:
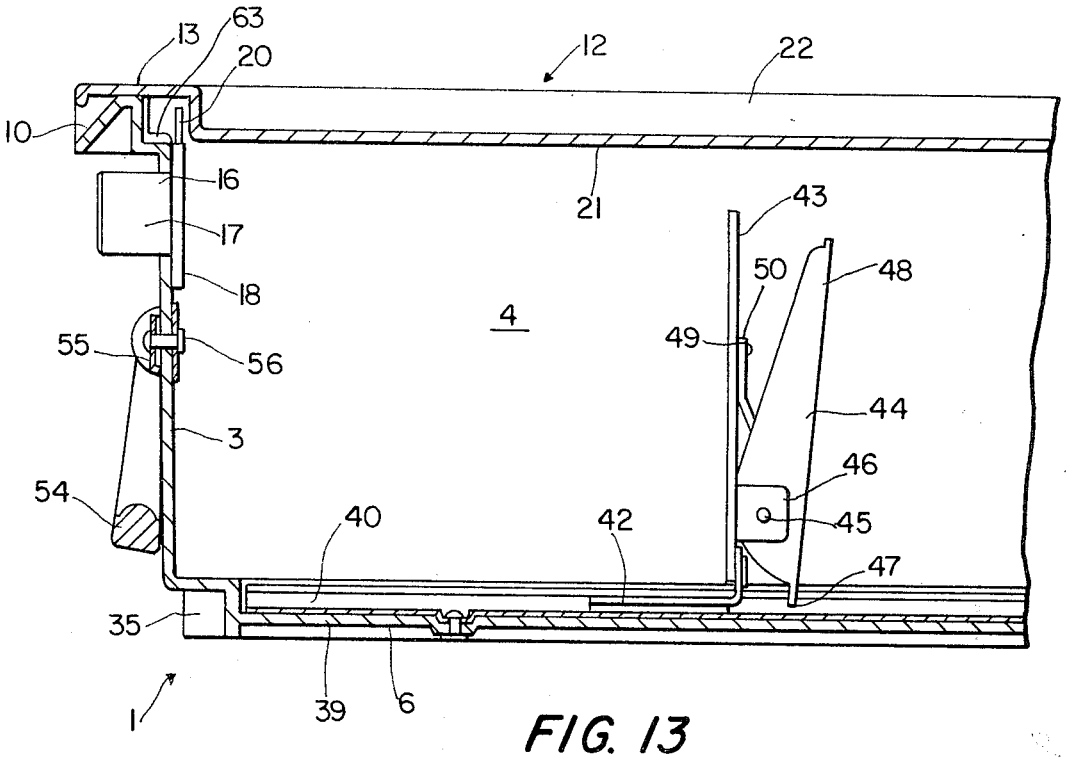
FIG. 13 is a cross-sectional view taken along line 13—13 of FIG. 12.
Figure 15:
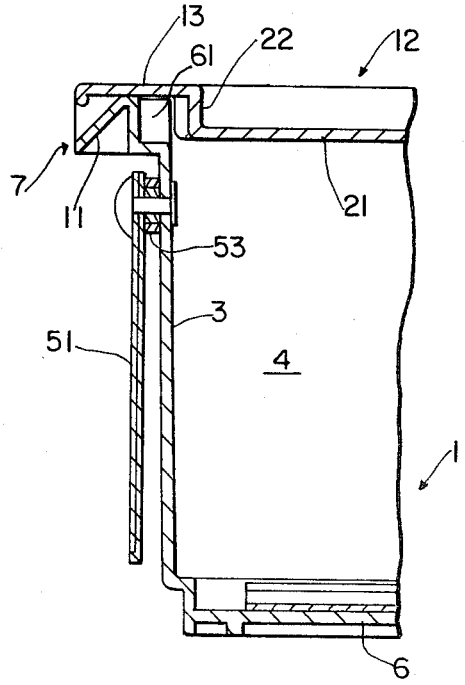
FIG. 15 is a cross-sectional view taken along line 15—15 of FIG. 14.
Figure 16:
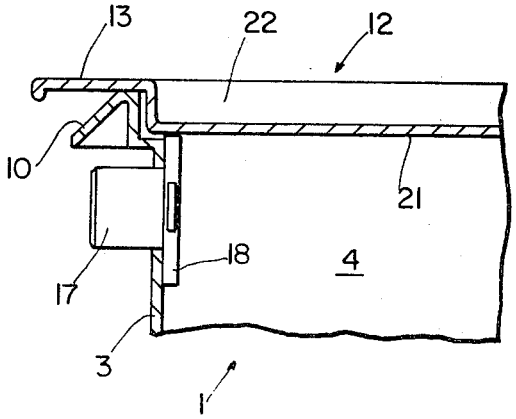
FIG. 16 is a cross-sectional view of a portion of FIG. 13, showing the key lock in a different position.
Figure 17:
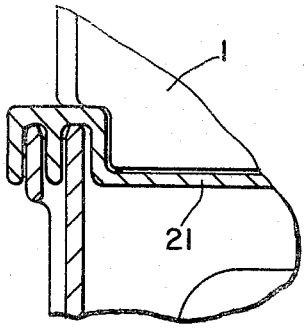
FIG. 17 is a cross-sectional view taken along line 17—17 of FIG. 3.
Figure 19:
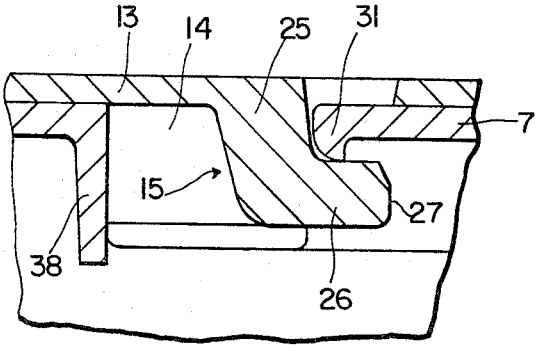
FIG. 19 is a cross-sectional view similar to FIG. 18, but showing the lid and container in a different relative position.

When in their locked position of FIG. 19, a number of different structures may be employed to lock or securely retain the lid in such position and resist or prevent its movement from the locked position of FIG. 19 to the closed position of FIG. 18. One such device is a key lock 16 having a cylindrical body 17 that passes through a circular aperture in the end wall 3 of the container, as shown in FIGS. 12 and 13. The lock 16 is further provided with an annular flange 18 that overlies the adjacent inside portion of the end wall 3, to prevent the outward removal of the lock. The lock is further secured by two rivets 19 that pass through aligned apertures in the end wall 3 and the flange 18. As mentioned previously, the lid is moved from its closed position of FIG. 18 to its locked position of FIG. 19 by moving the lid toward the end wall 2. Movement of the lid from the position of FIG. 19 to the position of FIG. 18 is prevented by means of the extended plunger of the lock 16 as shown in FIG. 13. When it is desired to remove the lid, the key (not shown), which is of conventional construction in general, is inserted within the lock 16 and rotated to withdraw the plunger 20 from its position of FIG. 13 to its position of FIG. 16, where it is seen that the lid may now assume the closed position of FIGS. 16 and 18. It is seen that each lid is provided with a flat planar horizontal major midportion that is rectangular. This midportion 21 is horizontally inset and vertically recessed from the lid flange 13 and joined to the lid flange 13 by means of a continuous vertical wall 22 forming opposed side and end walls for the lid. It is seen in FIG. 13, that it is this lid wall 22 that will engage the plunger 22 to prevent the movement of the lid from its position of FIG. 19 to its position of FIG. 18.

Figure 21:
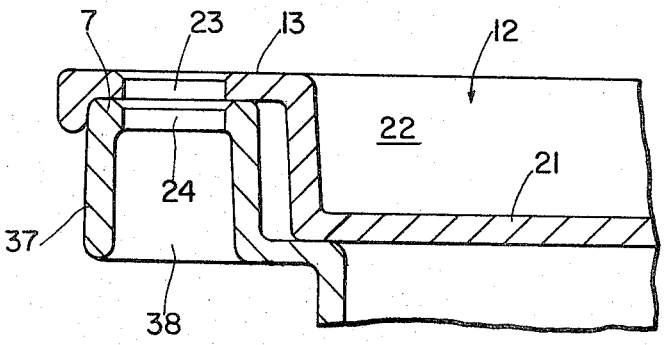
FIG. 21 is a cross-sectional view taken along line 21—21 in FIG. 3.
Figure 20:
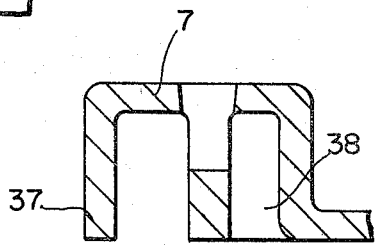
FIG. 20 is a cross-sectional view taken along line 20—20 in FIG. 10.

FIG. 21 illustrates a second structure that may be used to secure the lid and container in the locked position of FIG. 19. In such locked position, an aperture 23 in the flange 13 of the lid 12 is aligned with an aperture 24 in the flange 7 of the container 1. A simple security tie (not shown), such as a rope, piece of wire, plastic loop fastener, or the like, may be passed through the aligned apertures 23 and 24 and secured. Some such fasteners can only be disassembled by destroying them, which would indicate that the contents of the box may have been tampered with. For more security, the shackle of a conventional pad lock (not shown) could be passed through the apertures 23, 24.

As a third device for securing the lid and container in their locked position of FIG. 19, the hook and adjacent container may interlock as shown in FIGS. 18 and 19. While three devices have been shown, it is understood that only one may be used or any combination of two may used, or all three may be used as illustrated. Each hook is provided with a downwardly extending shaft portion 25 and a horizontally extending return portion 26 that in the position of FIG. 19 underlies the container flange 7. In order to reinforce the area of the lid around the opening 14, there is provided a flange downwardly depending tab portion 31. Upon further movement, the position of FIG. 19 is attained wherein the hook engages the tab 31 to form a friction connection.

Figure 8:
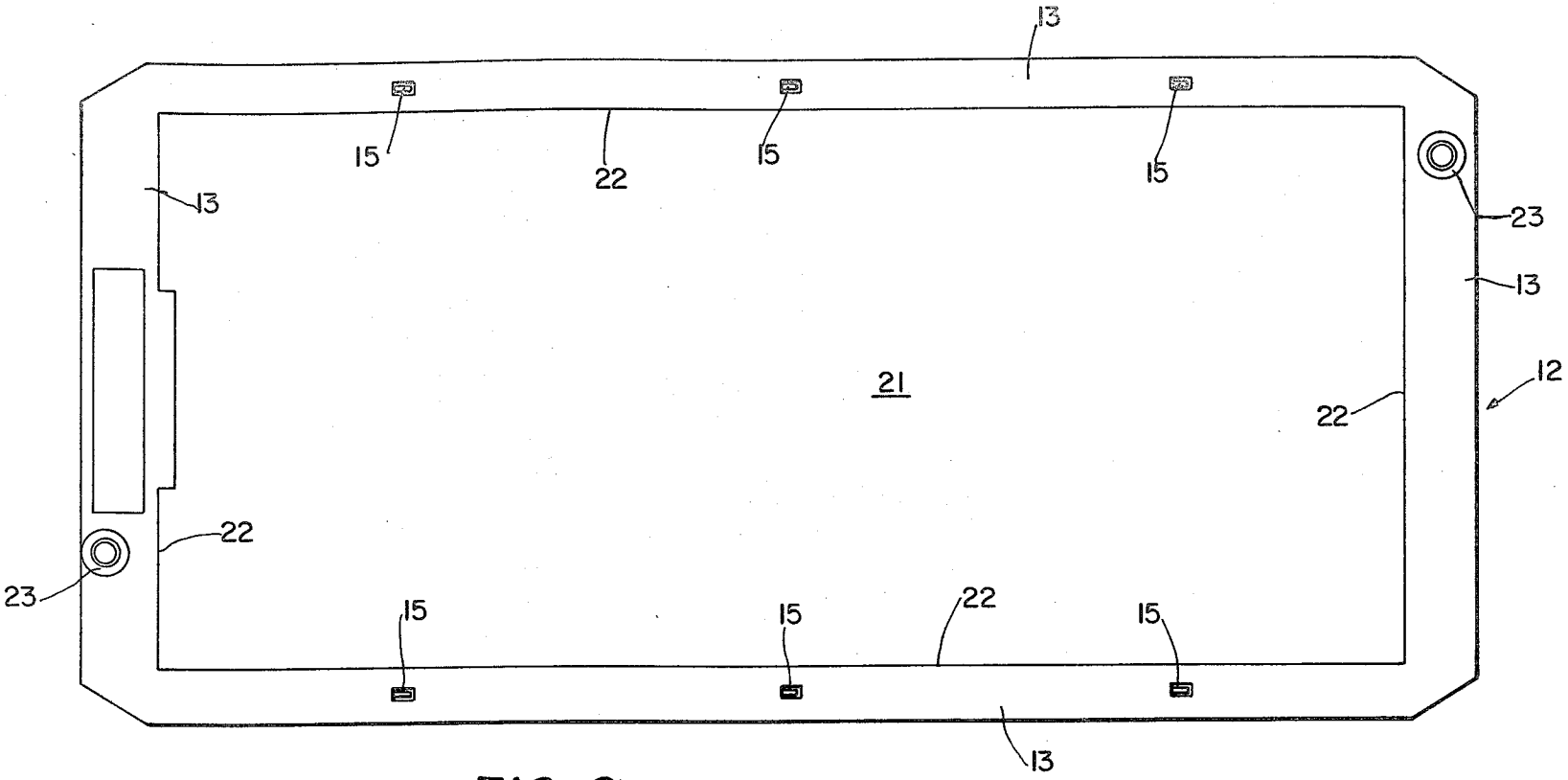
FIG. 8 is a top plan view of the lid for the box of the present invention.
Figure 10:
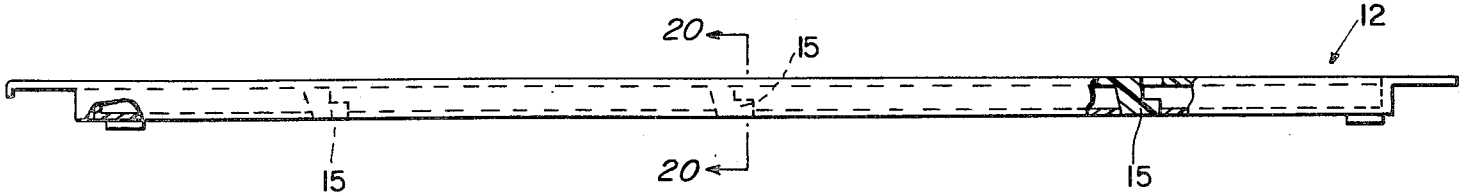
FIG. 10 is a side elevation view of the lid.

To facilitate interlocking of the bottom of one container with the lid of another container when in the stacked position of FIG. 2, the lid and bottom are provided with telescopically interfitting structure. As mentioned above, the lid is provided with an inset and recessed midportion 21. Similarly, the bottom is of substantially the same shape and smaller than the lid midportion, so that in the position of FIG. 2, the top container is being restrained from horizontal movement in any direction by the lid wall 22. The bottom wall 6 comprises a generally rectangular midportion 32 that is horizontally inset with respect to the end walls 2, 3 and side walls 4, 5. The bottom 6 further includes a peripheral bottom flange 34 that is connected around its entire periphery to the adjacent lowermost edges of the end walls 2, 3 and side walls 4, 5. The bottom flange 34 is at a higher elevation than the bottom midportion 32 so that the midportion 32 is recessed with respect to the remainder of the bottom wall 6. A vertical flange 33 forms a part of the bottom wall and integrally connects, around its entire periphery, the horizontal bottom flange 34 and the bottom midportion 32. This vertical bottom flange 33 nests within the vertical lid flange 22 in the position of FIG. 2 with respect to adjacent boxes in the stack. This nesting arrangement of the flanges 33, 22 can be assumed in only one orientation of adjacent boxes, because the vertically aligned lid end wall shown to the left in FIGS. 8 and 9 (not the lid lid end wall shown to the right in FIGS. 8 and 9), and the container end flange 10 are all configured similarly with a mid-horizontally protruding portion 35, whereas the respective opposed end walls are planar. Therefore, the containers and lids cannot stack telescopically in any positions relatively rotated from the positions shown in FIGS. 1 and 2, unless of course adjacent ones are simultaneously rotated the same degree.

Various measures are provided to strengthen both the container and the lid. The container is provided with a plurality of vertically extending ribs 36 that extend outwardly from the side walls. The flange 7 provides rigidity to the upper portion of the container. The lid walls 22 provide rigidity to the lid. An additional vertical flange 37 extends around the entire periphery of the container and depends integrally from the container flange 7. A plurality of webs 38 extend between and are integrally joined to the flanges 37, 7 and adjacent side and end walls of the container.

Figure 9:
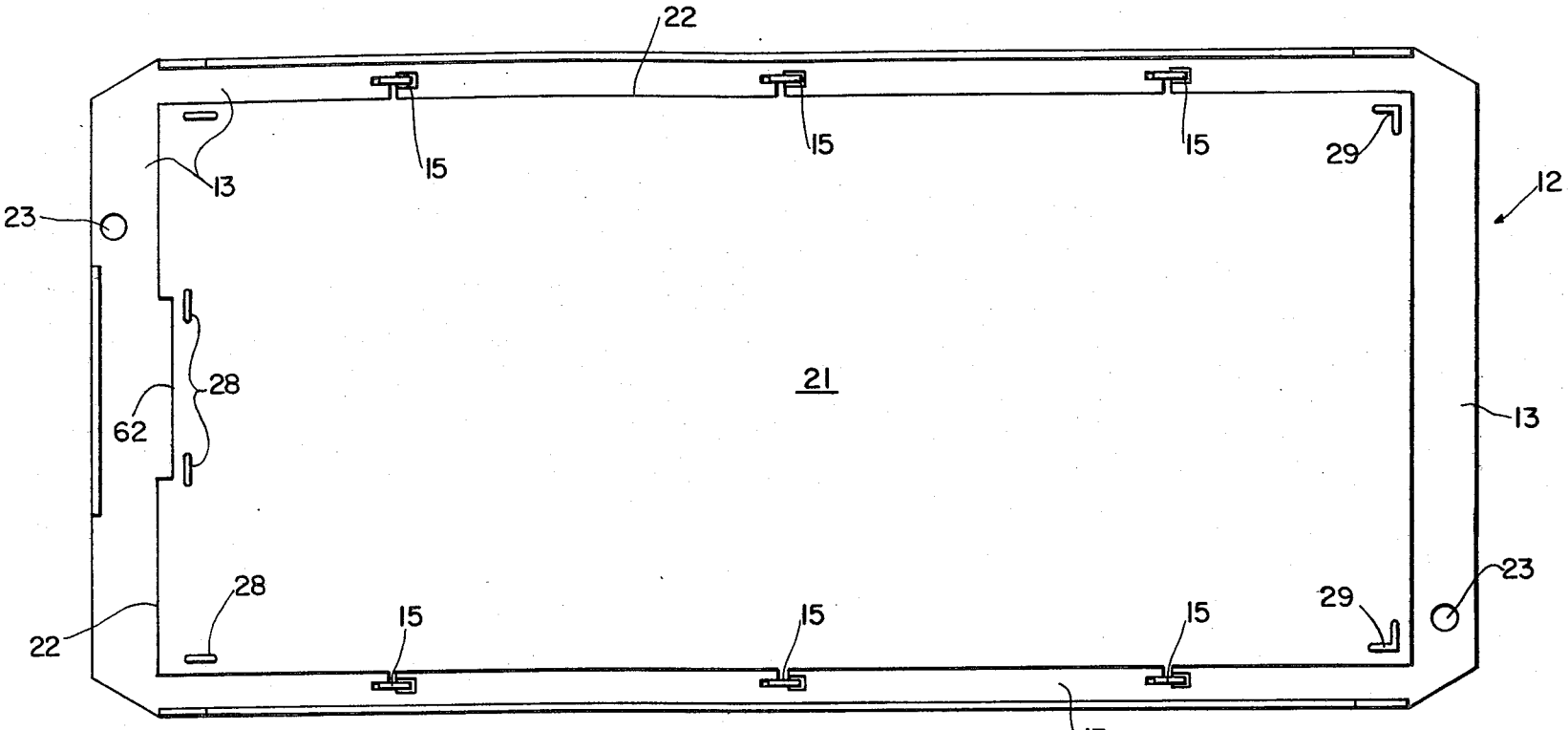
FIG. 9 is a bottom plan view of the lid of FIG. 8.
Figure 11:
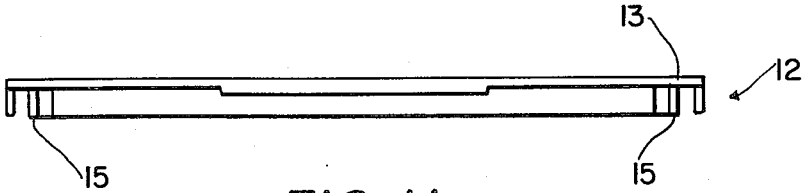
FIG. 11 is an end elevation view of the lid.

As shown in FIG. 9, downwardly depending small ribs 28 and 29 are provided to telescopically engage within the central recessed portion of an adjacent lower lid to provide an interlock situation between stacked lids in storage, when only a plurality of lids are stacked one upon another. When the boxes only, that is without lids, are stacked one upon another as shown in FIG. 1, the vertical ribs 36 also provide the function of engaging the top flange 7 of the next lower box to prevent nesting of the boxes that would injure papers contained therein.

Figure 3:
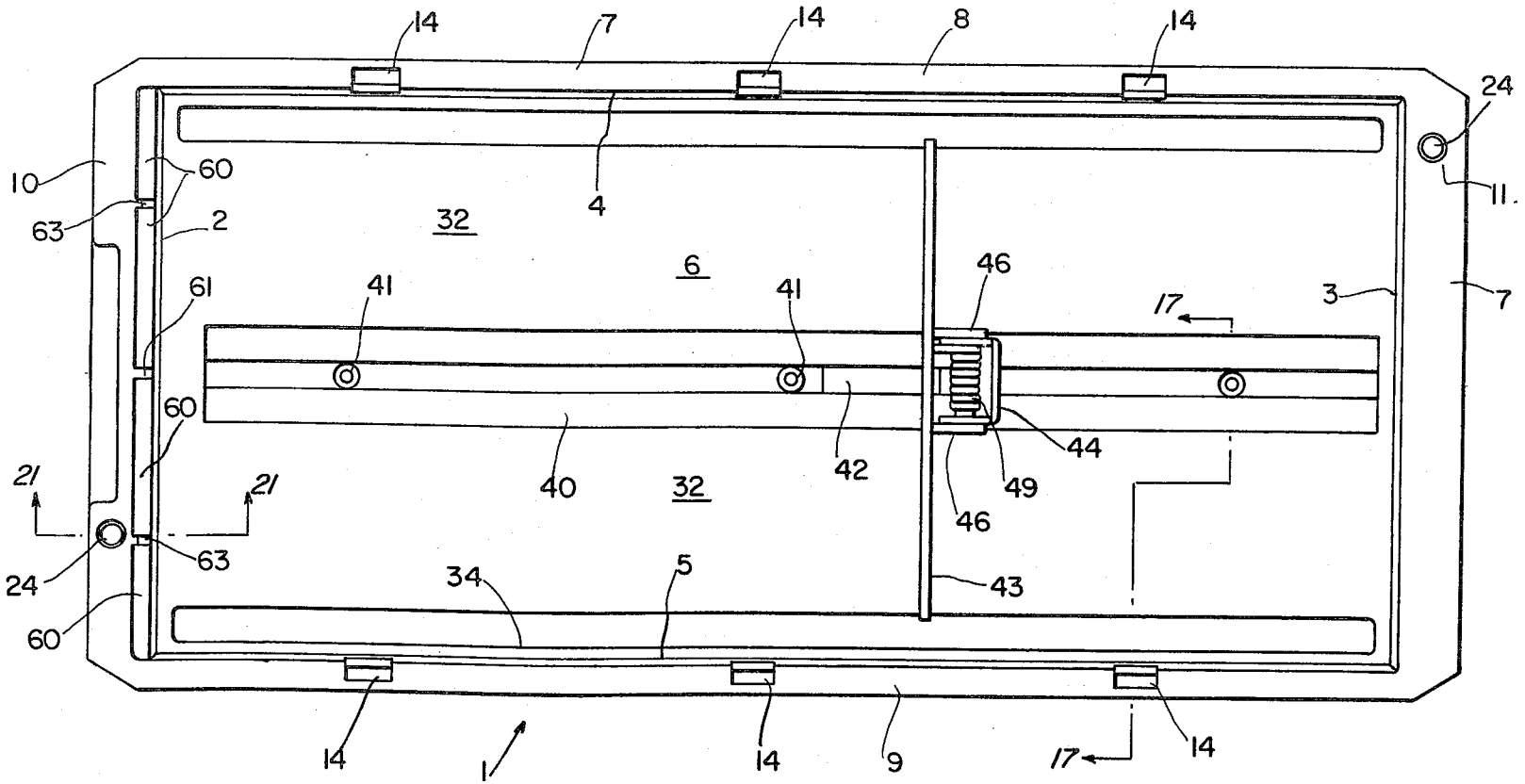
FIG. 3 is a top plan view of the container.
Figure 4:
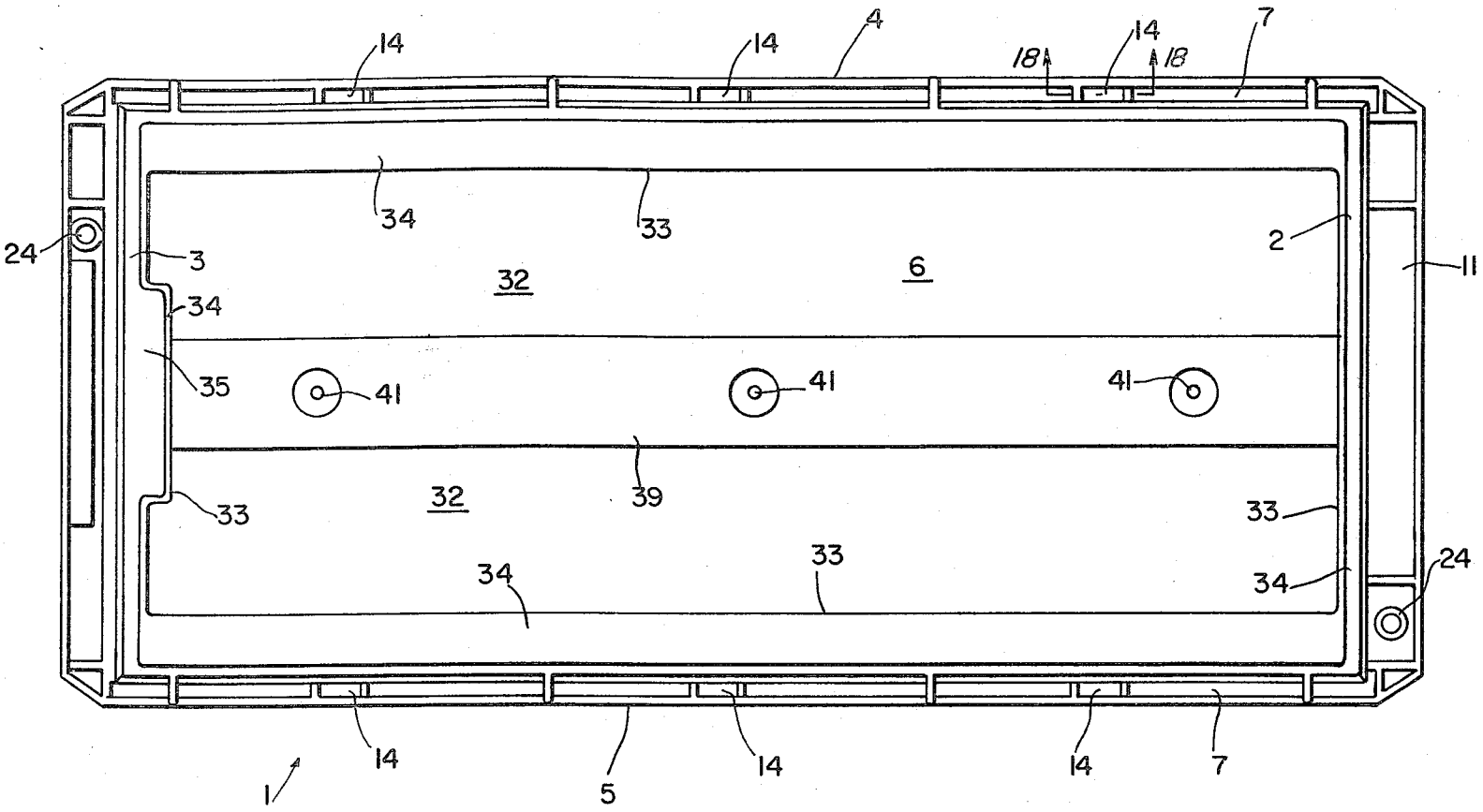
FIG. 4 is a bottom plan view of the container of FIG. 3.
Figure 5:
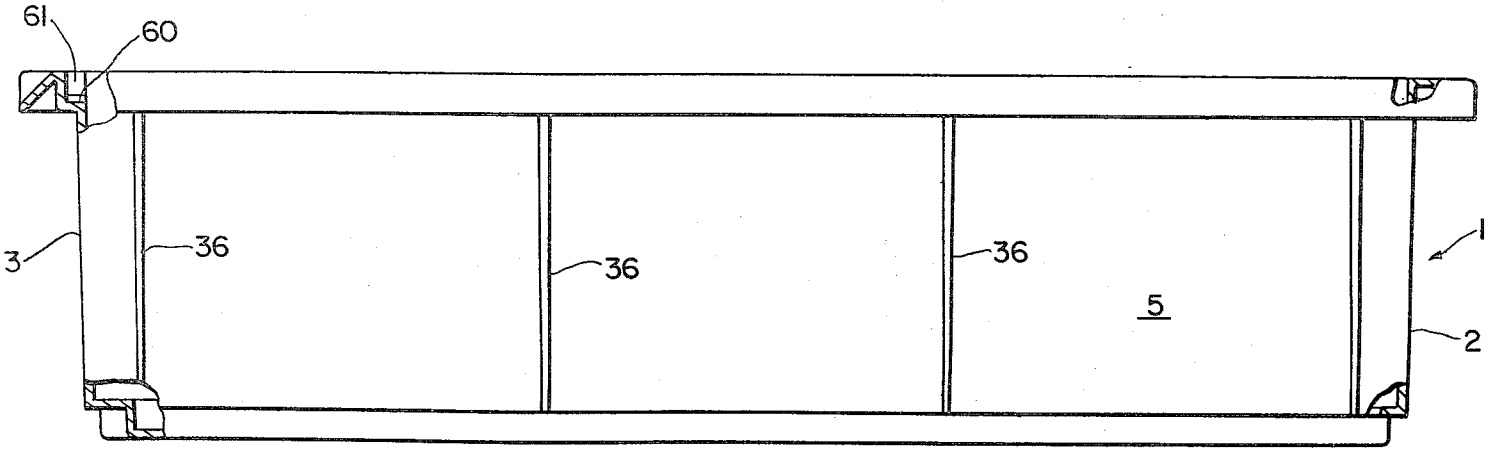
FIG. 5 is a side elevation view of the container, with portions broken away to illustrate structure.

As seen in FIG. 3 and in the cutaway portion of FIG. 5, the front end of the box, at the top, is provided with a shelf like horizontal surface 60 recessed within the front wall 2 for receiving the forwardmost edge of lid midportion 21. A full height rib 61 extends upwardly integrally from this shelf 60 to the level of the top surface of the flange 7. When the lid is correctly oriented, it will fit snugly into the top of the box as aforementioned with this full height rib 61 being received within an offset portion 62 of the lid shown in FIG. 9. However, if the lid were rotated 180 degrees, that is misoriented, this full height rib 61 would prevent the lid from being received within the box and would prevent engagement of the hooks 15 within the openings 14, so that the assembler would know that the assembly is being done incorrectly. Partial height ribs 63 extend only a small distance upwardly from the shelf 60 so that when the lid is in the position of FIG. 19, movement of the lid toward the position of FIG. 18 is positively blocked by such ribs 63, and movement to the position of FIG. 18 is only accomplished by lifting the forward edge of the lid to thereby warp the lid temporarily so that the midportion 21 of the lid may be moved upwardly over and across the ribs 63. Therefore, the ribs 63 are an additional means for locking the lid in a closed position.

The bottom wall 6 of the container is provided with a central channel 39 that is downwardly recessed from the remaining midportion 32 of the bottom wall. The channel 39 extends for substantially the entire length of the bottom midportion 32 parallel to the adjacent side walls. A metallic channel member 40 having a uniform cross section throughout its length is secured within the central channel by means of a plurality of rivets 41 that extend through the bottom wall and channel member. The channel member, due to its uniform cross sectional shape, provides an upwardly opening T-shaped slot in which is slidingly received a tongue 42. The tongue 42 is part of an L-shaped partition having a partition wall 43 integral with the tongue 42, both of which are preferably constructed of sheet metal. The partition wall 43 extends vertically over a major cross sectional area of the container interior. The L-shaped partition 42, 43, is selectively locked in different positions along the length of the container so as to adjust the size of the container interior to different volumes of papers to be held therein. This adjustment locking is provided by a lock lever 44 that is pivotally secured to the partition wall 43 about a horizontal pivot axis 45 by suitable bearing, preferably being a rod secured in the lock lever 44 and passing through holes in vertical ears 46 that are rigid with the partition wall 43. The rod forming the pivot axis 45 is horizontal and perpendicular to the side walls. The lock lever has a friction portion 47 at its lower terminal end for engaging the channel member at a point below and horizontally offset from the pivot axis 45 in the direction toward the end wall 2. It is seen that with this engagement as illustrated in FIG. 13, the tongue 42 will prevent the L-shaped partition from moving upwardly and any force caused by papers against the partition wall 43 to move the partition wall 43 away from the end wall 3 will be prevented by the toggle action or canting action of the lever between the pivot axis 45 and the engagement point of the friction portion 47. The lock lever 44 is additionally provided with a hand engageable portion 48 that is spaced from and adjacent the top of the partition wall 43 and generally diametrically opposed to the friction portion 47 with respect to the pivot axis 45. The hand engageable portion 48 may be grasped and moved toward the partition wall 43 to release the friction portion 47 from its locked position illustrated in FIG. 13 to a released position wherein it is spaced from the channel member and out of engagement with the channel member so that thereafter in the released position, the partition wall may be adjusted in the direction of the box length. A torsion spring 49 is helically wrapped about the pivot axis 45 and connected at one end 50 to the partition wall 43 and at its opposite end (not shown) to the lock lever 44 to bias the lock lever into its engaged position. Alternatively, the lock lever may be weighted so that gravity will bias it into its engaged position. Preferably, the partition wall 43, tongue 42, lock lever 44, spring 49, rod forming the pivot axis 45, and attached structure are constructed of metal, although they may be constructed from other materials.

To identify the contents of the boxes, there is preferably provided a transparent envelope 51 having an open end 52 for receiving therein an identification card (not shown). The envelope 51 is secured to the end wall 3 by means of a rivet and a spacer 53.

To facilitate handling of the boxes, a loop shaped handle 54 is rotatably secured by means of a suitable fastener 55 secured to the end wall 3 by a rivet 56, so that it may be swung from its normal weight biased position shown in FIG. 13 substantially 90 degrees or less outwardly in a clockwise direction from its illustrated position in FIG. 13 during usage.

Figure 6:
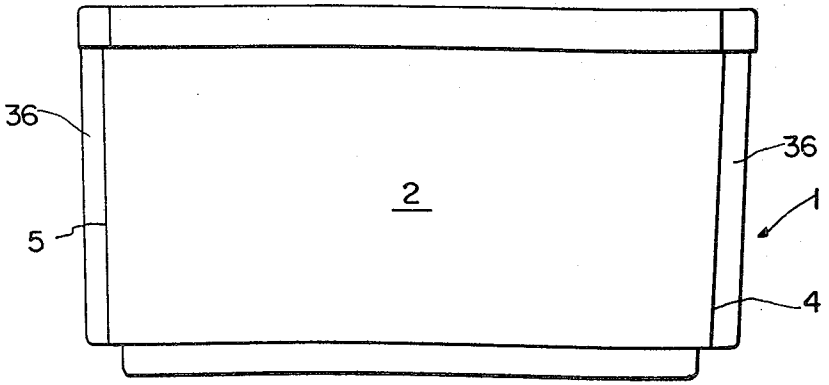
FIG. 6 is one end view of the container, with certain auxiliary structure not shown.
Figure 7:
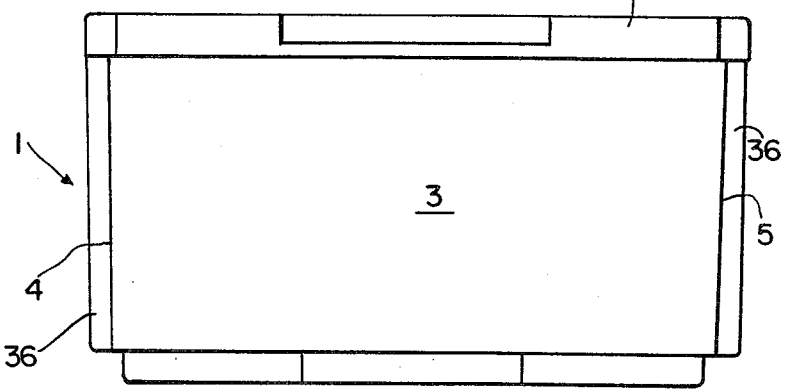
FIG. 7 is an opposite end view of the container with certain auxiliary structure not shown.

The container has been illustrated in FIGS. 5, 6, and 7 without the key lock 17, handle 54 and envelope 51 for purposes of illustration. In fact, if desired, such items may be omitted although they are desirable in their own right.

While a preferred embodiment including various details has been shown for purposes of illustrating the present invention, further embodiments, variations and modifications are possible in accordance with the broader aspects of the present invention, all as defined by the spirit and scope of the following claims.

What is claimed is:

1. A security storage box for papers of a similar size, such as checks, comprising:

a one-piece molded synthetic resin open-topped container having opposed generally parallel side walls, opposed generally parallel end walls, and a rectangular bottom wall integrally connected around its entire periphery with respective lowermost edges of said side and end walls, with said side and end walls being serially connected together in a closed alternate array along adjacent vertically extending edges;

the upper edge portions of said side and end walls opposed to said bottom wall including integrally formed outwardly extending horizontal flanges connected together around substantially the entire upper periphery of said container to constitute side and end flanges, said side flanges having a plurality of through apertures;

a lid separate from said container and integrally molded from synthetic resin in one piece, said lid being of a size and a rectangular shape to close the open top of said container with the peripheral edge portion of said lid being rectangular and having a flange overlying the flanges of said container, said lid integrally being formed with a plurality of hooks depending in one piece from its peripheral edge portion in alignment with and to extend through said through apertures of said container; and said hooks and through apertures being of a size and shape so that in one relative position of said lid and container said lid may be translated generally vertically from a disengaged position above said container to a closed position on said container with said hooks extending completely through said apertures and thereafter translated horizontally parallel to said side walls to engage said hooks beneath said container flanges to a locked position.

2. The box of claim 1, further including separate lock means to secure said lid and container against horizontal translation from said locked position to said closed position.

3. The box of claim 2, wherein said lock means includes a key operated lock permanently secured to one end wall of said container and having a vertically translateable plunger extendable to abutingly engage said lid in its locked position.

4. The box of claim 3, further including a separate pivotally mounted handle on the container end wall having said lock means.

5. The box of claim 4, including a separate transparent envelope permanently secured to the container end wall opposite to said end wall having therein said handle and adapted to receive a similarly shaped identification card.

6. The box of claim 2, wherein each of said hooks includes a downwardly extending shaft portion and a horizontally extending return portion, and said container flange has a downwardly extending reinforcing tab portion immediately adjacent each through aperture so that with movement of said lid from its closed position to its locked position, said hook return portion will frictionally engage said container tab in the locked position.

7. The box of claim 2, wherein said lock means includes said lid flange and said container flange in said locked position having at least one pair of aligned through apertures for receiving therethrough a security tie.

8. The box of claim 1, wherein said lid includes a flat planar horizontal major midportion that is rectangular, inset with respect to the periphery of said lid and recessed with respect to the lid flange;

said lid further including vertically extending side and end walls integrally joining said recessed and inset lid midportion and said lid peripheral flange;

said container bottom is substantially the same shape and smaller than said lid midportion so that one container may be stacked upon the lid closing a second like container with said one container bottom wall resting on said lid midportion and said one container being restrained from horizontal movement in any direction by said lid side and end walls.

9. The box of claim 8, wherein one of said side and end walls of each of said lid and said container are configured the same as each other and differently than their corresponding opposed walls so that a container may stack within a lid in only one orientation and not stack within said lid in any other orientation rotated therefrom.

10. The box of claim 1, wherein said container peripheral edge portion is provided with a vertical flange downwardly depending from the outer edges of said container horizontal flanges, parallel to respective side and end walls, continuously around the periphery of said container;

and including a plurality of webs extending between said vertical flange and the adjacent container side and end walls;

and said container apertures extending into the space between said side and end walls and their adjacent vertical flanges between said webs.

11. The box of claim 1, wherein said bottom wall includes a central channel downwardly recessed from the remainder of said bottom wall for substantially the entire length of said side walls and parallel to said side walls;

channel member secured within said central channel and having a T-shaped, upwardly opening, slot formed therein extending substantially the full length of said box;

an L-shaped partition formed by a flat partition wall extending vertically over a major cross sectional area of the container interior and integrally connected with a horizontally extending tongue telescopically received within said T-shaped slot; and means for locking said partition selectively at different positions.

12. The box of claim 11, wherein said means for locking is a lock lever pivotally secured to said partition wall about a horizontal pivot axis extending perpendicular to said side walls, said lock lever having a friction portion engaging one of said channel member and bottom wall at a point horizontally offset from said pivot axis away from said partition wall, said lock lever having a hand engageable portion spaced from and adjacent the top of said partition wall generally diametrically oppposed to said friction portion relative to said pivot axis for movement from a locked position wherein said friction portion is in engagement and a release position more closely adjacent said partition wall wherein said friction portion is out of engagement, and means for biasing said lock lever into said locked position.

13. The box of claim 12, wherein said channel member, said partition and said lock lever are constructed of metal.

14. A security storage box for papers of a similar size, such as checks, comprising:

a one-piece molded synthetic resin open-topped container having opposed generally parallel side walls, opposed generally parallel end walls, and a rectangular bottom wall integrally connected around its entire periphery with respective lowermost edges of said side and end walls, with said side and end walls being serially connected together in a closed alternate array along adjacent vertically extending edges;

the upper edge portions of said side and end walls opposed to said bottom wall including integrally formed outwardly extending horizontal flanges connected together around substantially the entire upper periphery of said container to constitute side and end flanges, said side flanges having a plurality of through apertures;

a lid separate from said container and integrally molded from synthetic resin in one piece, said lid being of a size and a rectangular shape to close the open top of said container with the peripheral edge portion of said lid being rectangular and having a flange overlying the flanges of said container;

wherein said bottom wall includes a central channel downwardly recessed from the remainder of said bottom wall for substantially the entire length of said side walls and parallel to said side walls;

channel member secured within said central channel and having a T-shaped, upwardly opening, slot formed therein extending substantially the full length of said box;

an L-shaped partition formed by a flat partition wall extending vertically over a major cross sectional area of the container interior and integrally connected with a horizontally extending tongue telescopically received within said T-shaped slot; and means for locking said partition selectively at different positions.

15. The box of claim 14, wherein said means for locking is a lock lever pivotally secured to said partition wall about a horizontal pivot axis extending perpendicular to said side walls, said lock lever having a friction portion engaging one of said channel member and bottom wall at a point horizontally offset from said pivot axis away from said partition wall, said lock lever having a hand engageable portion spaced from and adjacent the top of said partition wall generally diametrically opposed to said friction portion relative to said pivot axis for movement from a locked position wherein said friction portion is in engagement and a release position more closely adjacent said partition wall wherein said friction portion is out of engagement, and means for biasing said lock lever into said locked position.

16. The box of claim 15, wherein said channel member, said partition and said lock lever are constructed of metal.

17. A lidded box, comprising:

a one-piece molded synthetic resin open-topped container having opposed generally parallel side walls, opposed generally parallel end walls, and a rectangular bottom wall integrally connected around its entire periphery with respective lowermost edges of said side and end walls, with said side and end walls being serially connected together in a closed alternate array along the adjacent vertically extending edges;

the upper edge portions of said side and end walls opposed to said bottom wall including integrally formed outwardly extending horizontal flanges connected together around substantially the entire upper periphery of said container to constitute side and end flanges;

a lid separate from said container and integrally molded from synthetic resin in one piece, said lid being of a size and a rectangular shape to close the open top of said container with the peripheral edge portion of said lid being rectangular and having a flange overlying the flanges of said container, said lid integrally being formed with a plurality of hooks depending in one piece from its peripheral edge portion;

said hooks and said container side and end flanges being of a size and shape so that in one relative position of said lid and container, said lid may be translated generally vertically from a disengaged position above said container to a closed position on said container and thereafter translated horizontally parallel to said side walls to engage said hooks beneath said container flanges to a locked position; and one of said container and lid having at least one vertically extending rib and the other having a horizontal portion that positively engages said rib to prevent movement of said lid relative to said container from the locked position to the disengaged position, and said hooks when in the locked position preventing vertical movement of said lid in its entirety sufficiently to disengage said rib, and said lid being sufficiently resilient to provide resilient warpage when separating forces are applied between said lid and container immediately in the vicinity of said rib so as to disengage said rib and permit movement of said lid from its locked position to its disengaged position and permit said lid to snap behind said rib when moved from its disengaged position to its locked position.

18. The box according to claim 8 wherein one of said end walls includes an outwardly extending shelf portion horizontally and vertically inset with respect to the uppermost edge of said one of said end walls, said shelf portion extending a distance greater than the distance between said vertically extending side walls of said lid, such that when said lid is translated vertically from said disengaged position to said closed position, said shelf portion provides a clearance for said vertically extending end walls of said recessed and inset lid midportion adjacent said one of said end walls, said clearance providing for said lid and said container to be vertically aligned with respect to said hooks extending completely through said apertures, and further said clearance allowing for said lid to be translated horizontally towards the other of said end walls to the locked position.

19. The box of claim 18, further including said shelf portion having a full height vertically extending rib, and one of said vertically extending end walls of said lid having a vertically recessed portion inset horizontally with respect to said vertically extending end wall and adapted to receive said vertically extending rib such that when said lid is incorrectly oriented with respect to said container, said vertically extending rib will prevent the other of said end walls from being received vertically and horizontally within said shelf portion.

20. The box according to claim 19, wherein said shelf portion further includes one of said container and lid having at least one vertically extending rib and the other having a horizontal portion that positively engages said rib to prevent movement of said lid relative to said container from the locked position to the disengaged position, and said hooks when in the locked position preventing vertical movement of said lid in its entirety sufficiently to disengage said rib, and said lid being sufficiently resilient to provide resilient warpage when separating forces are applied between said lid and container immediately in the vicinity of said rib so as to disengage said rib and permit movement of said lid from its locked position to its disengaged position and permit said lid to snap behind said rib when moved from its disengaged position to its locked position.

21. The box according to claim 8, wherein said lid further includes vertically extending alignment ribs protruding downwardly from the bottom surface of said recessed lid midportion for providing against horizontal translational movement between vertically adjacent stacked lids by said alignment ribs extending within said recessed lid midportion of a vertically adjacent stacked lid.

* * * * *